US009932530B2

(12) United States Patent
Garg et al.

(10) Patent No.: US 9,932,530 B2
(45) Date of Patent: Apr. 3, 2018

(54) REFINING USED MOTOR OIL THROUGH SUCCESSIVE HYDROTREATING PROCESSES

(71) Applicant: AIR PRODUCTS AND CHEMICALS, INC., Allentown, PA (US)

(72) Inventors: Diwakar Garg, Emmaus, PA (US); Timothy D. Lebrecht, New Tripoli, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 881 days.

(21) Appl. No.: 14/306,893

(22) Filed: Jun. 17, 2014

(65) Prior Publication Data

US 2015/0361356 A1 Dec. 17, 2015

(51) Int. Cl.
*C10G 65/04* (2006.01)
*C10G 67/02* (2006.01)
(Continued)

(52) U.S. Cl.
CPC ..... *C10G 65/04* (2013.01); *C10G 7/003* (2013.01); *C10G 7/06* (2013.01); *C10G 67/02* (2013.01);
(Continued)

(58) Field of Classification Search
CPC .... C10G 2300/1007; C10G 2300/1059; C10G 2300/1074; C10G 65/04; C10G 67/02
See application file for complete search history.

(56) References Cited

U.S. PATENT DOCUMENTS 3,269,958 A * 8/1966 Gatsis ..... B01J 37/0201 208/216 PP
3,919,076 A 11/1975 Cutler et al.
(Continued)

FOREIGN PATENT DOCUMENTS

EP 0574272 B1 4/2000

OTHER PUBLICATIONS

Parkash, Surinder, Refining Processes Handbook, 2003, Gulf Publishing, pp. 203-209.*

*Primary Examiner* — Renee Robinson
*Assistant Examiner* — Derek N Mueller
(74) *Attorney, Agent, or Firm* — Amy Carr-Trexler

(57) ABSTRACT

A method for refining used motor oil using two or more hydrotreating reactors arranged in series. The used motor oil may be vacuum distilled to produce an unrefined gasoil. The unrefined gasoil may then be hydrotreated in a first hydrotreating reactor with hydrogen operated at a temperature ranging from approximately 245° C. to approximately 260° C. to produce a hydrotreated gasoil. The hydrogen may comprise a mixture of fresh hydrogen and recycled hydrogen recovered from the last of the two or more hydrotreating reactors. The hydrotreated gasoil may then be hydrotreated in one or more additional hydrotreating reactors operated at temperatures ranging from approximately 260° C. to approximately 330° C. to produce a refined gasoil. The first hydrotreating reactor may remove a substantial portion of metallic impurities from the unrefined impurities, while the one or more additional hydrotreating reactors remove a substantial portion of heteroatom impurities from the unrefined gasoil.

39 Claims, 2 Drawing Sheets

(51) Int. Cl.

| | |
|---|---|
| ***C10G 67/06*** | (2006.01) |
| *C10G 7/00* | (2006.01) |
| *C10G 7/06* | (2006.01) |

(52) U.S. Cl.

CPC ..... *C10G 2300/1007* (2013.01); *C10G 2300/1059* (2013.01); *C10G 2300/1074* (2013.01)

(56) References Cited

U.S. PATENT DOCUMENTS

| | | | |
|---|---|---|---|
| 4,151,072 | A | 4/1979 | Nowack et al. |
| 4,512,878 | A | 4/1985 | Reid et al. |
| 7,638,040 | B2 | 12/2009 | Van Wees et al. |

* cited by examiner

| | | |
|---|---|---|
| Oil composition | | |
| C, wt.% | 85.6 | |
| H, wt.% | 14.4 | |
| N, wt.% | 0.2 | |
| O, wt.% | 0.4 | |
| S, wt.% | 0.09 | |
| | | |
| Oil feed rate, lbm/min | 177 | |
| | | |
| S in feed, lbm/min | 0.16 | Oil flow(lbm/min)x0.09 (S, wt.%)/100 |
| S in feed, lb-mole/min | 0.005 | Divide by molecular wt of S (32) |
| $H_2 + S = H_2S$ | | |
| $H_2$ required, lb-mole/min | 0.005 | 1 mole of $H_2$ for 1 mole of S |
| $H_2$ required, scfm | 1.79 | 1 mole of $H_2$ = 359 standard cubic feet |
| | | |
| N in feed, lbm/min | 0.355 | Oil flow(lbm/min)x0.2 (N, wt.%)/100 |
| N in feed, lb-mole/min | 0.025 | Divide by molecular wt of N (14) |
| $3H_2 + N_2 = 2NH_3$ | | |
| $H_2$ required, lb-mole/min | 0.075 | 3 mole of $H_2$ for 1 mole of $N_2$ |
| $H_2$ required, scfm | 27.27 | 1 mole of $H_2$ = 359 standard cubic feet |
| | | |
| O in feed, lbm/min | 0.71 | Oil flow(lbm/min)x0.4 (O, wt.%)/100 |
| O in feed, lb-mole/min | 0.044 | Divide by molecular wt of O (16) |
| $2H_2 + O_2 = 2H_2O$ | | |
| $H_2$ required, lb-mole/min | 0.088 | 2 mole of $H_2$ for 1 mole of $O_2$ |
| $H_2$ required, scfm | 31.86 | 1 mole of $H_2$ = 359 standard cubic feet |
| | | |
| Total $H_2$ required, scfm | 60.92 | |

FIG. 2

REFINING USED MOTOR OIL THROUGH SUCCESSIVE HYDROTREATING PROCESSES

TECHNICAL FIELD

The present invention relates generally to refining used oil and, more particularly, to refining used motor oil through a process including two or more hydrotreating steps.

BACKGROUND

Millions of gallons of used motor oil (or lubricating oil) are generated each day in the US, and a vast majority of used oil is improperly disposed each year. Lubricating oil, which is essentially a mixture of paraffinic, naphthenic, and aromatic hydrocarbons, is stable and does not degrade or wear out. However, additives, including both inorganic and organometallic additives, that are added to enhance motor oil, such as to improve its lubricating and anti-wear properties, oxidize, deplete, and wear out. Consequently, used motor oil needs to be treated to remove worn-out additives prior to recycling it as a feedstock for preparing fresh motor oil.

Refining of used motor oil began in earnest in the 1970s. Early processes involved removing contaminants such as dirt, water, fuel, and additives by a wide variety of unit operations including dehydration, distillation, treatment with chemicals and clays, solvent extraction, and solvent de-asphalting. More recently, however, many more additives have been developed and are used in improving properties of the motor oil. The total amount of additives currently being added to prepare fresh motor oil used in the US is estimated to be close to 20 weight percent. Due to the costs associated with recovery of solvent, inability of clays to remove modern additives, cost associated with disposal of spent clays and chemicals, and production of re-refined oil with inconsistent quality, such processes have fallen out of favor. Therefore, a process for refining used motor oil containing high percentages of additives is desirable.

SUMMARY OF THE INVENTION

Embodiments of the present invention include methods of treating used motor oil to remove metallic and heteroatom impurities. The method includes vacuum distilling a used oil to produce an unrefined gasoil, hydrotreating the unrefined gasoil in a first hydrotreating reactor operated at a temperature ranging from approximately 245° C. to approximately 260° C. to produce a hydrotreated gasoil, and hydrotreating the hydrotreated gasoil in one or more additional hydrotreating reactors operated at temperatures ranging from approximately 260° C. to approximately 330° C. to produce a refined gasoil. The first hydrotreating reactor may remove a substantial portion of metallic impurities from the unrefined gasoil, while the one or more additional hydrotreating reactors remove a substantial portion of heteroatom impurities from the hydrotreated gasoil, so that the refined gasoil includes less than approximately 0.05 wt. % nitrogen, less than approximately 0.1 wt. % oxygen, and less than approximately 100 ppmw sulfur, and less than approximately 0.1 ppmw calcium, less than approximately 0.1 ppmw magnesium, less than approximately 0.2 ppmw sodium, less than approximately 0.5 ppmw silicon, less than approximately 0.1 ppmw zinc, less than approximately 1 ppmw phosphorus, and less than approximately 1 ppmw boron. The first hydrotreating reactor may remove approximately 40% or more of the metallic impurities of the unrefined gasoil, preferably approximately 60% or more, and more preferably approximately 70% or more.

Hydrogen may be flowed into the first hydrotreating reactor at a flow rate varying from approximately 5,000 cubic meters (m3) to approximately 20,000 m3 per m3 of the unrefined gasoil, preferably 5,500 m3 to approximately 10,000 m3 per m3 of the unrefined gasoil, and more preferably approximately 5,500 m3 to approximately 8,000 m3 per m3 of gasoil at normal temperature and pressure. Each of the first hydrotreating reactor and the one or more additional hydrotreating reactors operate at a pressure ranging from approximately 500 pounds per square inch gauge (psig) to approximately 2,000 psig, preferably approximately 700 psig to approximately 1,500 psig, and more preferably approximately 900 psig to approximately 1,350 psig. Each of the hydrotreating reactors may contain a nickel-molybdenum catalyst or a cobalt-molybdenum catalyst, or a combination of nickel-molybdenum catalyst and cobalt-molybdenum catalyst.

To improve the economic efficiency of the process, a portion of the hydrogen may be recovered after the one or more additional hydrotreating reactors and recycled back into the first hydrotreating reactor. To avoid accumulation of impurities, a portion of the recovered hydrogen may be purged before recycling the remaining portion back into the first hydrotreating reactor. To maintain the flow rate of total hydrogen into the first reactor, a fresh hydrogen stream may be added to the recycled hydrogen stream to replace hydrogen consumed by the reaction and hydrogen lost in the purged portion of the recovered hydrogen. The flow rate of the fresh hydrogen is at least in excess of the stoichiometric amount of hydrogen required to remove most of the heteroatom impurities from the unrefined gasoil, preferably approximately 1.5, approximately 2.0, or approximately 2.5 times greater than the required amount, depending on the volume of the purged portion.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures:

FIG. 2 is an exemplary calculation for determining the stoichiometric amount of hydrogen required to remove heteroatom impurities from an unrefined gasoil.

DETAILED DESCRIPTION

Figure 1:
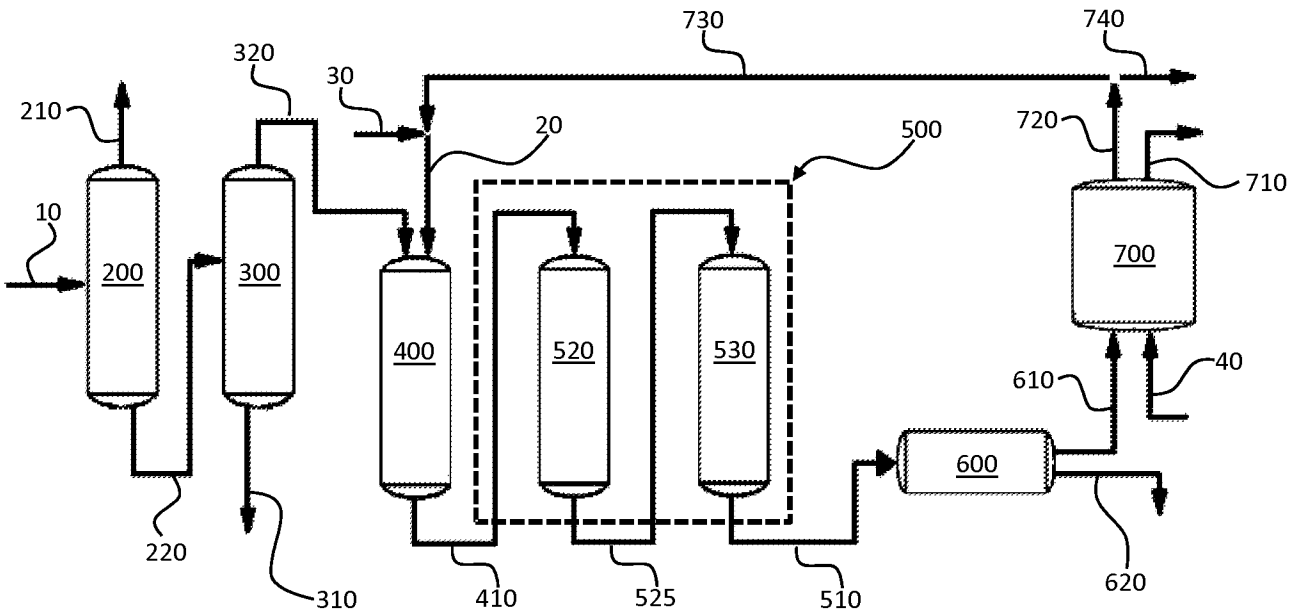
FIG. 1 is a process diagram depicting refining used motor oil, according to an embodiment of the present invention.

Modern motor oil may include any number of additives to improve its performance that, once used, must be removed from motor oil before the oil may be recycled. Some of these additives include organometallic compounds of (1) zinc and phosphorous to improve anti wear, anti-corrosion, and anti-oxidant properties, (2) sodium, calcium and magnesium as detergents, (3) silicon as dispersants and anti-foam agents, and (4) phosphorous as friction modifiers. The total amount of additives currently being added to prepare fresh motor oil used in the US is estimated to be close to 20 weight percent (wt. %), though oils having greater or lesser additive concentrations are possible. While motor oil is discussed specifically throughout this description, the disclosed refining process may be used to equal effect to refine other used hydrocarbon oils containing more than trace amounts of metallic impurities.

Used motor oil may be refined through a hydrotreating process (also referred to as hydrogenolysis) largely copied from a process for hydrotreating petroleum-based gasoil developed primarily to remove nitrogen, oxygen and sulfur compounds from the petroleum-based gasoil using one of more fixed bed reactors packed with Ni—Mo or Co—Mo catalyst supported on alumina. According to the process for hydrotreating petroleum-based gasoil, the used motor oil may be vacuum distilled into one or more gasoil fractions that are then flowed into the hydrotreating reactor operated at a pressure varying from 500 to 2,000 psig and a temperature varying from approximately 275° C. to approximately 375° C. under flowing hydrogen. The flow rate of pure hydrogen can vary from approximately 5,000 cubic meters (m3) to approximately 20,000 m3 per cubic meter of gasoil at normal temperature and pressure with liquid hourly space velocity (LHSV) typically varying from approximately 0.5 hr-1 to approximately 5 hr-1. In some processes, a series of successive hydrotreating reactors may be utilized, where the first reactor is intended to remove most of the metals by hydrodemetallization and the remaining reactors are intended to remove most of the sulfur, nitrogen, and oxygen compounds (collectively referred to hereinbelow, for the purposes of this description, as "the heteroatom impurities") as well as hydrogenate gasoil.

However, the process described above was designed for petroleum-based gasoil containing trace amounts of metal-containing compounds including nickel and vanadium, for example in the form of nickel and vanadium porphyrin. In contrast, used motor oils such as those intended to be refined by the process described herein may contain at least tens to hundreds of parts per million of additives mostly in the form of organometallic compounds. Because of the use of high temperatures used in the process of hydrotreating petroleum-based gasoil, refining used motor oil according to the above process may result in the motor oil undergoing thermal cracking and rapid deactivation of the hydrotreating catalyst due to coke and/or carbon formation. Therefore, there is a need for a new process for refining used motor oil by hydrotreating that effectively removes metallic impurities, produces refined oil with the desired levels of heteroatom impurities, avoids thermal cracking, improves yield, and maintains sufficiently high levels of catalyst life.

Referring now to the drawing, in which like reference numbers refer to like elements throughout the various figures that comprise the drawing, FIG. 1 illustrates a preferred embodiment of a process for refining used motor oil. In the preferred embodiment of FIG. 1, the used oil 10 may optionally be dehydrated in a dehydration unit 200 to produce a dehydrated oil 220. The dehydrated oil 220 is then flowed into a vacuum distillation system 300 to distill the dehydrated oil 220 into an unrefined gasoil 320. The unrefined gasoil 320 is then flowed into a first hydrotreating reactor 400 to produce a first hydrotreated gasoil 410 having a substantially less metal concentration than the unrefined gasoil 320. The first hydrotreating reactor 400 may be operated at temperatures ranging from approximately 245° C. to approximately 260° C. The first hydrotreated gasoil 410 is then be flowed into one or more additional hydrotreating reactors 500, for example second hydrotreating reactor 520 and third hydrotreating reactor 530, to produce a refined gasoil 510 having the desired levels of the metallic and heteroatom impurities. The one or more additional hydrotreating reactors may be operated at temperatures ranging from approximately 260° C. to approximately 330° C. Each step of the process is described in more detail below.

In a first optional step of the process, the used motor oil 10 is typically dehydrated in a dehydration unit 200 to remove water and light components such as solvents, glycols, and light organic compounds from the used motor oil 10 and form a dehydrated oil 220. The used motor oil 10 may be dehydrated by heating the used motor oil to temperatures up to approximately 170° C. The water and light oil may be removed from the dehydration unit 200 in a first stream 210 that may be processed further to recover light components such as solvents, glycols, and light organic compounds. In a preferred embodiment, the dehydrated oil 220 has a water concentration of less than 1 wt. %. In some embodiments where the used motor oil 10 already includes a sufficiently low concentration of water, the dehydration process may be excluded from the process. For the purposes of this description, the dehydrated oil 220 is therefore either a used motor oil that has undergone a dehydration process or a used motor oil where dehydration was determined to be unnecessary.

In the embodiment depicted in FIG. 1, the dehydrated oil 220 is distilled in the vacuum distillation system 300 to separate the dehydrated oil 220 into one or more gasoil fractions, including for example a light, medium, and heavy gasoil fractions, and an undistilled fraction. The vacuum distillation system 300 may include one or more thin-film or wiped-film evaporators operated in a series with the temperatures in the evaporator or evaporators progressively increased to fractionate the used motor oil into fractions having boiling points ranging from approximately 200° C. to approximately 400° C. at atmospheric temperature. The undistilled fraction of the dehydrated oil 220 may include large amounts of metals, dirt, carbon, coke, and other insoluble impurities, and may be recovered from the vacuum distillation unit 300 in a second stream 310 and disposed of, or recycled for other uses, for example as residual tar for road and roof construction. However, at least some of the organometallic additives of the dehydrated oil 220 may be thermally stable and boil in the same temperature ranges as the gasoil fractions, and therefore may also contaminate the gasoil fractions. These gasoil fractions may be hydrotreated individually or combined and then hydrotreated as an unrefined gasoil 320. The elemental composition of the combined gasoil fractions may include approximately 84 wt. % to approximately 87 wt. % carbon, approximately 12 wt. % to approximately 15 wt. % hydrogen, approximately 0.01 wt. % to approximately 0.5 wt. % nitrogen, approximately 0.1 wt. % to approximately 0.8 wt. % oxygen, and approximately 200 parts per million weight (ppmw) to approximately 1400 ppmw sulfur. The combined gasoil fractions may further include metallic impurities with concentrations ranging from approximately 0.1 ppmw to approximately 25 ppmw calcium, approximately 0.1 ppmw to approximately 25 ppmw magnesium, approximately 0.1 ppmw to approximately 15 ppmw sodium, approximately 1 ppmw to approximately 25 ppmw silicon, approximately 0.1 ppmw to approximately 25 ppmw zinc, approximately 1 ppmw to approximately 50 ppmw phosphorus, and approximately 0.1 ppmw to approximately 25 ppmw boron.

The unrefined gasoil 320 from the vacuum distillation system 300 is then flowed from the vacuum distillation system 300 to a first hydrotreating reactor 400 to remove a substantial portion of the metallic impurities from the unrefined gasoil 320, resulting in a first hydrotreated gasoil 410 having a substantially lower metal concentration than the unrefined gasoil 320. The metal concentration in the first hydrotreated gasoil 410 may be reduced by approximately 40% or more relative to the unrefined gasoil 320, preferably by approximately 60% or more, and more preferably by approximately 70% or more. In other words, the first hydrotreated gasoil 410 may have a metal concentration of approximately 60% or less than the unrefined gasoil, preferably approximately 40% or less, and more preferably approximately 30% or less. The unrefined gasoil 320 may include one or more of the gasoil fractions produced by the vacuum distillation system 300. For example, all of the distilled gasoil fractions may be remixed after distillation and hydrotreated in a single process. Alternatively, each distilled gasoil fraction may be hydrotreated separately. The temperature of the first hydrotreating reactor 400 is high enough to cause the thermal decomposition of the organometallic additives in the unrefined gasoil 320, but not so high that substantial thermal cracking of the hydrocarbons of the unrefined gasoil 320 occurs. If the temperature of the first hydrotreating reactor 400 is too low, the duty of removing the undecomposed organometallic additives will be passed to the subsequent reactors. If the temperature of the first hydrotreating reactor 400 is too high, it will result in thermal cracking of the gasoil hydrocarbons, thereby reducing the yield of hydrotreated gasoil while rapidly deactivating the catalyst of the first hydrotreating reactor 400 by carbon or coke formation. The first hydrotreating reactor 400 may also remove some of the heteroatom impurities from the unrefined gasoil 320, though most of the process of removing the heteroatom impurities is typically left to the additional hydrotreating reactors 500, described in more detail below. In a preferred embodiment, the first hydrotreating reactor 400 is a fixed bed reactor packed with a suitable hydrotreating catalyst, for example an alumina base impregnated with nickel-molybdenum (Ni—Mo), cobalt-molybdenum (Co—Mo), or a combination of Ni—Mo and Co—Mo and operated in a trickle bed mode at a temperature ranging from approximately 245° C. to 260° C. This operating temperature of the first hydrotreating reactor is selected to avoid both thermal cracking of the gasoil and catalyst deactivation by carbon or coke formation. In other embodiments, other suitable hydrotreating catalysts may be used. The pressure in the first hydrotreating reactor 400 may range from approximately 500 pounds per square inch gauge (psig) to approximately 2,000 psig, preferably approximately 700 psig to approximately 1,500 psig, and more preferably approximately 900 psig to approximately 1,350 psig.

To allow the hydrotreating reaction to occur in the first hydrotreating reactor 400 and the additional hydrotreating reactors 500, a hydrogen stream 20 is also flowed into the first hydrotreating reactor 400. In some embodiments, the hydrogen stream 20 may include a mixture of a fresh hydrogen stream 30 and a recycled hydrogen stream 730, described in greater detail below. In other embodiments, the hydrogen stream 20 may include only the fresh hydrogen stream 30. The total flow rate of the hydrogen stream 20 may range from approximately 5,000 m3 to approximately 20,000 m3 per 1 m3 of the unrefined gasoil 320 at normal temperature and pressure, preferably approximately 5,500 m3 to approximately 10,000 m3 per 1 m3 of the unrefined gasoil 320 at normal temperature and pressure, and more preferably approximately 5,500 m3 to approximately 8,000 m3 per 1 m3 of the unrefined gasoil 320 at normal temperature and pressure. Where the recycled hydrogen stream 730 is used, it will have a flow rate less than desired overall flowrate of the hydrogen stream 20 due to hydrogen being consumed by the hydrotreating reactions and some hydrogen being purged from the system rather than recycled. Accordingly, the fresh hydrogen stream 30 has a sufficiently high flow rate to maintain the desired overall flowrate of the hydrogen stream 20. The flow rates of the hydrogen stream 20 and the unrefined gasoil 320 may be adjusted relative to the size of the first hydrotreating reactor 400 and the additional hydrotreating reactors 500 so that the LHSV in the hydrotreating reactors ranges from approximately 0.5 hr-1 to approximately 5 hr-1, preferably 0.5 hr-1 to approximately 3 hr-1, and more preferably 0.5 hr-1 to approximately 2 hr-1.

By removing a substantial portion of the metallic impurities from the unrefined gasoil 320 in the first hydrotreating reactor 400, catalyst deactivation due to metal deposition in the one or more additional hydrotreating reactors 500 may be substantially reduced. While the conditions described above will result in decreased catalyst activity in the first hydrotreating reactor 400 over time, it is an advantage of the refining process described herein to have to only regularly change the catalyst in the first hydrotreating reactor 400 while extending catalyst life in the one or more additional hydrotreating reactors 500. When there is a sufficient decrease in catalyst activity or a rise in pressure drop in the first hydrotreating reactor 400, the process may be stopped and the catalyst changed only in the first hydrotreating reactor 400, reducing downtime relative to a process requiring changing the catalyst in all reactors.

The first hydrotreated gasoil 410, as well as the unreacted portion of the hydrogen stream 20, is then flowed from the first hydrotreating reactor 400 to the one or more additional hydrotreating reactors 500 to further reduce metallic impurities as well as reduce the concentration of the heteroatom impurities in the first gasoil 410 to below a desired level and produce a refined gasoil 510 having the reduced concentration of metallic and heteroatom impurities. In the embodiment depicted in FIG. 1, the one or more additional hydrotreating reactors include a second hydrotreating reactor 520 and a third hydrotreating reactor 530. However, while the additional hydrotreating reactors 500 will be referred to in the plural through the remainder of this description, the additional hydrotreating reactors 500 may include as few as one reactor or two or more reactors. It is preferable for the additional hydrotreating reactors 500 to include at least two additional hydrotreating reactors because it provides an option of gradually increasing the temperature for hydrotreating and avoiding catalyst deactivation by thermal cracking. Furthermore, it provides an option of using Co—Mo on alumina catalyst in one reactor and Ni—Mo on alumina catalyst in the other reactor. The use of two different catalysts may be desirable because Co—Mo is good for removing sulfur by hydrodesulfurization while Ni—Mo is good for hydrogenating oil. Alternatively, one can use a single reactor with top half packed of it packed with one catalyst and the bottom half with other catalyst. In a preferred embodiment, each of the additional hydrotreating reactors 500 is a fixed bed reactor packed with a suitable hydrotreating catalyst, for example an alumina base impregnated with Ni—Mo, Co—Mo, or a combination of Ni—Mo and Co—Mo, and operated in a trickle bed mode at a temperature ranging from approximately 260° C. to 330° C. In other embodiments, other suitable hydrotreating catalysts may be used. The pressure in the additional hydrotreating reactors 500 may range from approximately 500 psig to approximately 2,000 psig, preferably approximately 700 psig to approximately 1,500 psig, and more preferably approximately 900 psig to approximately 1,350 psig. While the conditions in each of the additional hydrotreating reactors 500 falls within these conditions, the conditions may not be the same within each of additional hydrotreating reactors 500. For example one of the additional hydrotreating reactors 500 may be packed with a Co—Mo catalyst, while the remaining additional hydrotreating reactors 500 may be packed with a Ni—Mo catalyst, or vice versa.

After being hydrotreated in the one or more additional hydrotreating reactors 500, the refined gasoil 510 preferably includes less than approximately 0.05 wt. % nitrogen, less than approximately 0.1 wt. % oxygen, and less than approximately 100 ppmw sulfur. The gasoil fractions preferably further include metallic impurities with concentrations ranging from less than approximately 0.1 ppmw calcium, less than approximately 0.1 ppmw magnesium, less than approximately 0.2 ppmw sodium, less than approximately 0.5 ppmw silicon, less than approximately 0.1 ppmw zinc, less than approximately 1 ppmw phosphorus, and less than approximately 1 ppmw boron.

After being hydrotreated in the one or more additional hydrotreating reactors 500, the refined gasoil 510 along with hydrogen and gaseous products may be cooled in a heat exchanger (not shown in FIG. 1) and then treated in a gas/liquid separator 600 to separate a more volatile gas phase 610 from a less volatile hydrotreated oil phase 620. The oil phase may then be distilled (not shown in FIG. 1) into various fractions and the fraction or fractions suitable for lubricating oil is reused in new motor oil products. The gas phase may contain unreacted hydrogen along with gaseous products produced during the hydrotreating reaction. The gaseous produced during the hydrotreating reaction may include carbon monoxide, carbon dioxide, ammonia, hydrogen sulfide, water vapor, and light hydrocarbons including methane, ethane, etc. In some embodiments, the gas phase 610 is then treated with a fresh water stream 40 in a water scrubber 700 to remove water and ammonia from the gas phase 610 and recover an impure hydrogen stream 720. The ammonia thus scrubbed from the gas phase 610 by water exits the water scrubber 700 along with fresh water as a third stream 710. In some embodiments, the fresh water stream 40 may include a caustic solution to remove both ammonia and hydrogen sulfide gases from the gas stream and produce an impure hydrogen stream 720 free of ammonia and hydrogen sulfide.

While the gas phase 610 may be treated to remove water, ammonia, and hydrogen sulfide, it typically is not treated to remove compounds such as light hydrocarbons, carbon monoxide, or carbon dioxide. Accordingly, the recovered hydrogen stream 720 may not contain pure hydrogen. In some embodiments, the recovered hydrogen stream 720 contains approximately 90 volume percent (vol. %) to approximately 98 vol. % hydrogen. A portion of this impure hydrogen stream may be recycled back as a recycle hydrogen stream 730 to the first hydrotreating reactor to reduce the overall cost of hydrogen and improve process economics. To avoid build up of concentration of carbon monoxide, carbon dioxide and light hydrocarbons in the recycle hydrogen stream 730, a part of the recovered hydrogen stream 720 may be purged as a stream 740 and removed from the system. The hydrogen purge stream 740 may have a flow rate ranging from approximately 1% to approximately 5% of the flow rate of recovered hydrogen stream 720, preferably approximately 1% to approximately 4% of the flow rate of recovered hydrogen stream 720, and more preferably approximately 2% to approximately 3% of the flow rate of recovered hydrogen stream 720. The flow rate of hydrogen purge stream may be determined and controlled by maintaining total pressure in the system. It may be desirable to periodically purge the entire recovered hydrogen stream 720 to maintain high hydrogen partial pressure in the hydrotreating reactors. To account for the hydrogen lost in the purged hydrogen stream 740, as well as hydrogen consumed in the first hydrotreating reactor 400 and the one or more additional hydrotreating reactors 500, the hydrogen stream 20 may include a fresh hydrogen stream 30 along with the recycled hydrogen stream 730, which may be compressed prior to recycling. The flow rate of the fresh hydrogen stream 30 must be sufficiently high to replace the hydrogen consumed by the hydrotreating reactions as well as an hydrogen lost in the hydrogen purge stream 740. At a minimum, the fresh hydrogen stream 30 has a flow rate in excess of the stoichiometric amount of hydrogen required to remove most of the heteroatom impurities from the unrefined gasoil 320. For example, the hydrogen volumetric flow rate of the fresh hydrogen stream 30 may be approximately 1.5 times greater than the stoichiometric amount of hydrogen required to remove most of the heteroatom impurities from the unrefined gasoil 320, preferably greater than 2 times the stoichiometric amount of hydrogen required to remove most of the heteroatom impurities from the unrefined gasoil 320, and more preferably greater than 2.5 times the stoichiometric amount of hydrogen required to remove most of the heteroatom impurities from the unrefined gasoil 320. By example, FIG. 2 depicts a calculation for determining the metric amount of hydrogen required to remove most of the heteroatom impurities from an unrefined gasoil of 85.6 wt. % carbon, 14.4 wt. % hydrogen, 0.2 wt. % nitrogen, 0.4 wt. % oxygen, and 900 ppm sulfur. 1.5 mole of hydrogen in the form of H2 is required to remove 1 mole of nitrogen, 2 mole of hydrogen is required to remove 1 mole of oxygen, and 1 mole of hydrogen is required to remove 1 mole of sulfur. The fresh hydrogen stream 30 is mixed with the recycled hydrogen stream 730 before being added to the first hydrotreating reactor 300, or the fresh hydrogen stream 30 and the recycled hydrogen stream 730 may be added to the first hydrotreating reactor 300 separately. To maintain desired levels of impurities in the hydrogen stream 20 and maintain desired hydrogen partial pressure in the first hydrotreating reactor 400 and the one or more additional hydrotreating reactors 500, the ratio of the recycled hydrogen stream 730 to the purged hydrogen stream 740 and the ratio of the recycled hydrogen stream 730 to the fresh hydrogen stream 30 may be dynamically adjusted during the hydrotreating process. By purging a portion of the recovered hydrogen 720, a feedback loop resulting in accumulation of these impurities in the hydrogen stream 20 is reduced while still improving the economic efficiency of the process by not using hydrogen only on a once-through basis.

EXAMPLES

The following examples illustrate determining suitable reactor conditions for embodiments of the process for refining used motor oil as described above. In each example, a gasoil was recovered from a used motor oil by a thin-film evaporation technique.

Example 1

A gasoil having the elemental composition and metal impurity contents listed below in Tables 1 and 2, respectively, were hydrotreated in four reactors operated in series.

TABLE 1

| | Element | | | | |
|---|---|---|---|---|---|
| | C | H | N | O | S |
| Concentration | 85.3 wt. % | 14.2 wt. % | 0.1 wt. % | 0.6 wt. % | 980 ppm |

TABLE 2

| | Element | | | | | | |
|---|---|---|---|---|---|---|---|
| | Ca | Mg | Na | Si | Zn | P | B |
| Conc. (ppm) | 0.5 | 0.2 | 0.8 | 17 | 0.4 | 30 | 10 |

The first reactor was packed with commercially available pre-sulfided Co—Mo catalyst supported on alumina and operated at a temperature of 308° C. The second reactor was also packed with commercially available pre-sulfided Co—Mo catalyst supported on alumina and operated at a temperature of 303° C. temperature. The third reactor was loaded with commercially available pre-sulfided Ni—Mo catalyst supported on alumina and operated at a temperature of 301° C. The fourth and last reactor was loaded with commercially available pre-sulfided Ni—Mo catalyst supported on alumina and operated at a temperature of 299° C. The oil was hydrotreated at approximately 1,200 psig pressure with 5391 standard m3 per m3 of oil of an impure recycled hydrogen stream combined with 17 standard m3 per m3 of oil of a fresh hydrogen stream. Because the recycled hydrogen stream contains less 100% hydrogen, the total hydrogen flow rate is less than the combined total flow rate of 5408 m3. The ratio of fresh hydrogen flow rate to stoichiometric flow rate of hydrogen required to remove sulfur, nitrogen and oxygen compounds was 1.14. The gasoil feed rate was such that it provided a LHSV of approximately 2 hr-1. After treating, the hydrotreated gasoil had the elemental composition and metal impurity contents listed below in Tables 3 and 4, respectively.

TABLE 3

| | Element | | | | |
|---|---|---|---|---|---|
| | C | H | N | O | S |
| Concentration | 85.6 wt. % | 14.1 wt. % | <40 ppm | 0.3 wt. % | 130 ppm |

TABLE 4

| | Element | | | | | | |
|---|---|---|---|---|---|---|---|
| | Ca | Mg | Na | Si | Zn | P | B |
| Conc. (ppm) | <0.01 | <0.01 | <0.3 | 1 | <0.09 | 9 | 1 |

While the process of Example 1 was effective in reducing the nitrogen content in the gasoil to below the desired value, the oxygen and sulfur contents remained higher than the desired values of less than 0.1 wt. % and less than 100 ppm, respectively. The hydrotreating process was also effective in reducing the concentration of calcium, magnesium, sodium, and zinc, but not effective at reducing the concentration of silicon, phosphorus, and boron to values below 1 ppm.

The hydrotreated oil was colorless, but unstable, and became dark with prolonged exposure to sunlight, probably due to the presence of a high concentration of oxygen. The hydrotreating process also produced more than desirable amount of light hydrocarbon gases, thereby reducing yield of the hydrotreated gasoil. Further, the hydrotreating process caused the pressure drop in the first reactor start increasing after only one week of operation.

The higher concentration of carbon and lower concentration of hydrogen, higher production of light hydrocarbon gases, and rapid increase in pressure drop in the first hydrotreating reactor were all likely caused by thermal cracking of gasoil. Lower hydrogen content in the hydrotreated gasoil compared to feed gasoil also indicates thermal cracking of the feed gasoil and a lack of the hydrogenation reaction. The rapid increase in pressure drop in the first reactor was caused not solely by metals deposition on the catalyst, but also by formation and deposition of carbon on the catalyst. The hydrotreating operation was eventually stopped to change catalyst in the first reactor.

Example 1 shows that the use of high temperature in the first and subsequent reactors coupled with low ratio of fresh hydrogen flow rate to stoichiometric flow rate of hydrogen required for removing heteroatoms were not effective in hydrotreating gasoil. The process of Example 1 resulted in the production of large amounts of undesirable light hydrocarbon gases, thereby reducing yield of hydrotreated gasoil, not removing all metallic impurities as well as oxygen and sulfur compounds, producing unstable gas oil, and above all rapidly deactivating catalyst by carbon or coke formation.

Example 2

A gasoil having the elemental composition and metal impurity contents listed below in Tables 5 and 6, respectively, were hydrotreated in three reactors operated in series.

TABLE 5

| | Element | | | | |
|---|---|---|---|---|---|
| | C | H | N | O | S |
| Concentration | 85.6 wt. % | 14.4 wt. % | 0.2 wt. % | 0.4 wt. % | 900 ppm |

TABLE 6

| | Element | | | | | |
|---|---|---|---|---|---|---|
| | Ca | Mg | Na | Si | Zn | P |
| Conc. (ppm) | 10 | 0.4 | 4 | 8 | 4 | 4 |

The first reactor was packed with commercially available pre-sulfided Ni—Mo catalyst and operated at a temperature of 235° C. The second reactor was also packed with commercially available pre-sulfided Ni—Mo catalyst and operated at a temperature of 257° C. temperature. The third and last reactor was loaded with commercially available pre-sulfided Co—Mo catalyst and operated at a temperature of 312° C. The gasoil was hydrotreated at approximately 1,175 psig pressure with 5865 standard m3 per m3 of oil of an impure recycled hydrogen stream combined with 18 standard m3 per m3 of oil of a fresh hydrogen stream. Because the recycled hydrogen stream contains less 100% hydrogen, the total hydrogen flow rate is less than the combined total flow rate of 5883 m3. The ratio of fresh hydrogen flow rate to stoichiometric flow rate of hydrogen required to remove sulfur, nitrogen and oxygen compounds was approximately 1.18. The gasoil feed rate was such that it provided a LHSV of approximately 0.8 hr-1. After treating, the hydrotreated gasoil had the elemental composition and metal impurity contents listed below in Tables 7 and 8, respectively:

TABLE 7

| | Element | | | | |
|---|---|---|---|---|---|
| | C | H | N | O | S |
| Concentration | 86.4 wt. % | 13.6 wt. % | <0.05 wt. % | 0.12 wt. % | 500 ppm |

TABLE 8

| | Element | | | | | |
|---|---|---|---|---|---|---|
| | Ca | Mg | Na | Si | Zn | P |
| Conc. (ppm) | 8 | 0.3 | 0.6 | 0.9 | 0.2-0.7 | <1 |

While the process of Example 2 was effective in reducing the nitrogen content in the gasoil to below the desired value, the oxygen and sulfur contents remained higher than the desired values of less than 0.1 wt. % and less than 100 ppm, respectively. The hydrotreating process was also not effective in reducing the concentration of the calcium metal impurity to less than 1 ppm.

The hydrotreated oil was dark in color and unstable, likely due to the presence of high oxygen concentration and incomplete removal of metallic impurities. The quality of hydrotreated oil was not good enough to be sold in the market place and needed to be reprocessed again.

While the process caused no increase in pressure drop in the first reactor, the pressure drop increased in the second and third reactors, indicating that the first reactor was not effective in decomposing and removing metallic impurities, and that the second and third reactors were doing the job of the first reactor of removing the metallic impurities. Further, the higher concentration of carbon and lower concentration of hydrogen in the hydrotreated gasoil compared to the untreated gasoil indicated that the process was not hydrogenating the gasoil but instead was thermally cracking a part of the gasoil. The thermal cracking was evidenced by the presence of coke on the catalysts recovered from the second and third reactors. Some thermal cracking may have also occurred due to the use of low ratio of fresh hydrogen flow rate to stoichiometric flow rate of hydrogen required for heteroatom removal.

Example 3

The gasoil hydrotreating process described in Example 2 was repeated using the same feed gasoil, same three reactors operated in series, and the same temperatures as in Example 2 in all three reactors. The flow rate of fresh hydrogen was increased to provide a ratio of fresh hydrogen flow rate to stoichiometric flow rate of hydrogen required for heteroatom removal of approximately 1.8. The oil was hydrotreated at approximately 1,175 psig pressure with 5865 standard m3 per m3 of oil of an impure recycled hydrogen stream combined with 27 standard m3 per m3 of oil of a fresh hydrogen stream. Because the recycled hydrogen stream contains less 100% hydrogen, the total hydrogen flow rate is less than the combined total flow rate of 5892 m3. The ratio of fresh hydrogen flow rate to stoichiometric flow rate of hydrogen required to remove sulfur, nitrogen and oxygen compounds was approximately 1.77. The gasoil feed rate was such that it provided a LHSV of approximately 0.8 hr-1. After treating, the hydrotreated gasoil had the elemental composition and metal impurity contents listed below in Tables 9 and 10, respectively.

TABLE 9

| | Element | | | | |
|---|---|---|---|---|---|
| | C | H | N | O | S |
| Concentration | 84.9 wt. % | 15.1 wt. % | <0.05 wt. % | 0.1 wt. % | 300 ppm |

TABLE 10

| | Element | | | | | |
|---|---|---|---|---|---|---|
| | Ca | Mg | Na | Si | Zn | P |
| Conc. (ppm) | 1 | <0.03 | <0.05 | 0.3 | 0.2 | <1 |

While the process of Example 3 was effective in reducing the nitrogen content in the gasoil to below the desired value, the oxygen and sulfur contents still remained higher than the desired values of less than 0.1 wt. % and less than 100 ppm, respectively. The process was somewhat more effective at removing the metal impurities relative to Example 2.

The hydrotreated oil was lighter in color than in Example 2 but still unstable, likely due to the presence of high oxygen concentration. The quality of hydrotreated oil was good enough to be sold in the market place, but not good enough to command a premium price.

While the process caused no increase in pressure drop in the first reactor, the pressure drop again increased in the second and third reactors, indicating that the first reactor was not effective in decomposing and removing metallic impurities even with the higher flow rate of fresh hydrogen, and that the second and third reactors were doing the job of the first reactor of removing the metallic impurities. The presence of lower concentration of carbon and higher concentration of hydrogen in the hydrotreated gasoil indicated that the process was effective in mildly hydrogenating the gasoil. However, the presence of coke on the catalysts recovered from the second and third reactors indicated that process was still causing some thermal cracking of the gasoil.

Example 4

The gasoil hydrotreating process described in Example 2 was repeated using the same feed gasoil, same operating pressure, same LHSV, and same total flow rate of hydrogen of recycled hydrogen. The temperature in the first reactor was increased to 249° C., the temperature in the second reactor increased to 277° C., and the temperature in the third reactor remained at 312° C. The flow rate of the fresh hydrogen stream was increased from 18 standard m3 per m3 of oil to 40 standard m3 per m3 of oil, so that the ratio of fresh hydrogen flow rate to stoichiometric flow rate of hydrogen required to remove sulfur, nitrogen and oxygen compounds was increased to approximately 2.65.

The process of Example 4 was effective in reducing the nitrogen content in the gasoil to below the desired value of less than 0.05 wt. % and reducing the oxygen content to about 0.1 wt. %, but still not effective in reducing sulfur content to the desired value of less than 100 ppm. The carbon content was marginally lower and hydrogen content was marginally higher in the hydrotreated oil than those observed in Example 3. The hydrotreating process was a bit more effective in reducing the concentration of metallic impurities from the gasoil—the calcium, silicon, and zinc content in the hydrotreated oil was 0.5 wt. %, 0.1 wt. %, and 0.1 wt. %, respectively.

The hydrotreated gasoil was pale yellow in color and unstable, and changed color slowly with time upon exposure to sunlight, likely due to the still higher than desired concentration of oxygen and remaining metallic impurities. While the hydrotreated oil was of sufficient quality to be sold in the marketplace, it would not command premium pricing.

Unlike Examples 2 and 3, the process of Example 4 resulted in no increase in pressure drop in the second and third reactors, and only a marginal increase in pressure drop in the first reactor, indicating that the first reactor was effective in decomposing and removing metallic impurities. Increasing the temperature of the first reactor therefore shifted the burden of removing metallic impurities from the second reactor and the third reactor to the first reactor, as desired.

Example 5

The gasoil hydrotreating process described in Example 4 was repeated using the same feed gasoil, same operating pressure, same LHSV, same flow rate of recycled hydrogen, same ratio of fresh hydrogen flow rate to stoichiometric flow rate of hydrogen required to remove sulfur, nitrogen and oxygen compounds, and same temperature in the first and third reactors. The temperature in the second reactor was increased to 288° C.

The process of Example 5 showed only marginal improvements in the color of the hydrotreated gasoil and removal of metallic impurities relative to Example 4. The elemental composition of the hydrotreated gasoil was very similar to that noted in Example 4 with sulfur content still higher than 100 ppm. The concentration of metals in the hydrotreated gasoil was also very similar to the ones noted in example 4. The hydrotreated gasoil was pale yellow in color and unstable, and changed color slowly with time upon exposure to sunlight. While the hydrotreated oil was of sufficient quality to be sold in the marketplace, it would not command premium pricing.

Example 6

The gasoil hydrotreating process described in Example 4 was repeated using the same feed gasoil, same operating pressure, same LHSV, same flow rate of recycled hydrogen, and same ratio of fresh hydrogen flow rate to stoichiometric flow rate of hydrogen required to remove sulfur, nitrogen and oxygen compounds. The temperature in the first reactor was increased to 260° C., the temperature in the second reactor was increased to 301° C., and the temperature in the third reactor remained at 312° C.

The hydrotreated gasoil was of excellent quality and met all of the desired elemental concentrations described above, namely less than approximately 0.05 wt. % nitrogen, less than approximately 0.1 wt. % oxygen, and less than approximately 100 ppmw sulfur, and less than approximately 0.1 ppmw calcium, less than approximately 0.1 ppmw magnesium, less than approximately 0.2 ppmw sodium, less than approximately 0.5 ppmw silicon, less than approximately 0.1 ppmw zinc, less than approximately 1 ppmw phosphorus, and less than approximately 1 ppmw boron. The hydrotreated gasoil was colorless and stable, did not change color upon prolonged exposure to sunlight, and was of excellent marketable quality.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What we claim is:

1. A process for refining used oil, the process comprising:

vacuum distilling a used oil to produce an unrefined gasoil;

hydrotreating the unrefined gasoil in a first hydrotreating reactor to produce a first hydrotreated gasoil, wherein the temperature in the first hydrotreating reactor ranges from approximately 245° C. to approximately 260° C.;

hydrotreating the first hydrotreated gasoil in one or more additional hydrotreating reactors to produce a refined gasoil, wherein the temperature in the one or more additional hydrotreating reactor ranges from approximately 260° C. to approximately 330° C., wherein the temperature of each consecutive hydrotreating reactor is increased relative to the prior hydrotreating reactor.

2. The process for refining used oil of claim 1, wherein the used oil comprises used motor oil.

3. The process for refining used oil of claim 1, wherein the unrefined gasoil comprises approximately 84 weight percent (wt. %) to approximately 87 wt. % carbon, approximately 12% to approximately 15 wt. % hydrogen, approximately 0.01 wt. % to approximately 0.5 wt. % nitrogen, approximately 0.1 wt. % to approximately 0.8 wt. % oxygen, and approximately 200 parts per million weight (ppmw) to approximately 1400 ppmw sulfur.

4. The process for refining used oil of claim 1, wherein the refined gasoil comprises less than approximately 0.05 wt. % nitrogen, less than approximately 0.1 wt. % oxygen, and less than approximately 100 ppmw sulfur.

5. The process for refining used oil of claim 1, wherein the unrefined gasoil comprises approximately 0.1 ppmw to approximately 25 ppmw calcium, approximately 0.1 ppmw to approximately 25 ppmw magnesium, approximately 0.1 ppmw to approximately 15 ppmw sodium, approximately 1 ppmw to approximately 25 ppmw silicon, approximately 0.1 ppmw to approximately 25 ppmw zinc, approximately 1 ppmw to approximately 50 ppmw phosphorus, and approximately 0.1 ppmw to approximately 25 ppmw boron.

6. The process for refining used oil of claim 1, wherein the refined gasoil comprises less than approximately 0.1 ppmw calcium, less than approximately 0.1 ppmw magnesium, less than approximately 0.2 ppmw sodium, less than approximately 0.5 ppmw silicon, less than approximately 0.1 ppmw zinc, less than approximately 1 ppmw phosphorus, and less than approximately 1 ppmw boron.

7. The process for refining used oil of claim 1, wherein each of the first hydrotreating reactor and the one or more additional hydrotreating reactors operate at a pressure ranging from approximately 500 pounds per square inch gauge (psig) to approximately 2,000 psig.

8. The process for refining used oil of claim 7, wherein each of the first hydrotreating reactor and the one or more additional hydrotreating reactors operate at a pressure ranging from approximately 700 psig to approximately 1,500 psig.

9. The process for refining used oil of claim 8, wherein each of the first hydrotreating reactor and the one or more additional hydrotreating reactors operate at a pressure ranging from approximately 900 psig to approximately 1,350 psig.

10. The process for refining used oil of claim 1, further comprising flowing hydrogen into the first hydrotreating reactor while hydrotreating the unrefined gasoil, wherein the hydrogen is present in the reactor from approximately 5,000 cubic meters ($m^3$) to approximately 20,000 $m^3$ per 1 $m^3$ of the unrefined gasoil.

11. The process for refining used oil of claim 1, further comprising flowing hydrogen into the first hydrotreating reactor while hydrotreating the unrefined gasoil, wherein the hydrogen is present in the reactor from approximately 5,500 $m^3$ to approximately 10,000 $m^3$ per 1 $m^3$ of the unrefined gasoil.

12. The process for refining used oil of claim 1, further comprising flowing hydrogen into the first hydrotreating reactor while hydrotreating the unrefined gasoil, wherein the hydrogen is present in the reactor from approximately 5,500 $m^3$ to approximately 8,000 $m^3$ per 1 $m^3$ of the unrefined gasoil.

13. The process for refining used oil of claim 10, wherein the hydrogen comprises a mixture of fresh hydrogen and recycled hydrogen that has been recovered from the last of one or more additional hydrotreating reactors.

14. The process for refining used oil of claim 13, wherein the flow rate of the fresh hydrogen is greater than approximately 1.5 times the stoichiometric amount necessary to remove the concentration of heteroatom impurities from the unrefined gasoil.

15. The process for refining used oil of claim 13, wherein the flow rate of the fresh hydrogen is greater than approximately 2.0 times the stoichiometric amount necessary to remove the concentration of heteroatom impurities from the unrefined gasoil.

16. The process for refining used oil of claim 13, wherein the flow rate of the fresh hydrogen is greater than approximately 2.5 times the stoichiometric amount necessary to remove the concentration of heteroatom impurities from the unrefined gasoil.

17. The process for refining used oil of claim 1, wherein each of each of the first hydrotreating reactor, and the one or more additional hydrotreating reactors contain a nickel-molybdenum catalyst, a cobalt-molybdenum catalyst, or a combination of nickel-molybdenum catalyst and cobalt-molybdenum catalyst.

18. The process for refining used oil of claim 1, wherein vacuum distilling the used oil removes contaminants from the used oil, wherein the contaminants comprises one or more substances selected from the group consisting of metals, dust, carbon, coke, and heavy polymers.

19. The process for refining used oil of claim 1, wherein vacuum distilling the used oil produces a plurality of gasoil fractions, wherein the unrefined gasoil comprises one of the plurality of gasoil fractions or a mixture of two or more of the plurality of gasoil fractions.

20. The process for refining used oil of claim 1, wherein hydrotreating the unrefined gasoil in the first hydrotreating reactor to produce the first hydrotreated gasoil produces the first hydrotreated gasoil having a metal concentration substantially less than the unrefined gasoil.

21. The process for refining used oil of claim 20, wherein the metal concentration of the first hydrotreated gasoil is approximately 60% or less than the metal concentration of the unrefined gasoil.

22. The process for refining used oil of claim 20, wherein the metal concentration of the first hydrotreated gasoil is approximately 40% or less than the metal concentration of the unrefined gasoil.

23. The process for refining used oil of claim 20, wherein the metal concentration of the first hydrotreated gasoil is approximately 30% or less than the metal concentration of the unrefined gasoil.

24. The process for refining used oil of claim 1, further comprising dehydrating the used oil prior to vacuum distilling the used oil.

25. The process for refining used oil of claim 1, further comprising separating the refined gasoil into a gas phase and a refined oil.

26. The process for refining used oil of claim 25, further comprising recovering hydrogen from the gas phase and recycling a portion of the recovered hydrogen into the first hydrotreating reactor.

27. The process for refining used oil of claim 1, wherein vacuum distilling the used oil separates the used oil into the unrefined gasoil and a heavy oil phase.

28. The process for refining used oil of claim 27, wherein the heavy oil phase is recovered for use as tar for road and roof construction.

29. A process for refining motor oil, the process comprising:

dehydrating the motor oil;

vacuum distilling the motor oil to produce a plurality of gasoil fractions;

adding one or more of the gasoil fractions and fresh hydrogen to a first hydrotreating reactor operating at approximately 245° C. to approximately 260° C. and approximately 500 psig to approximately 2,000 psig to produce a first hydrotreated gasoil having a metal concentration substantially less than the one or more gasoil fractions, wherein the fresh hydrogen is added in excess of a stoichiometric amount required to remove any sulfur, nitrogen, and oxygen from the one or more gasoil fractions;

adding the first hydrotreated gasoil to a second hydrotreating reactor operating at approximately 260° C. to approximately 300° C. and approximately 500 psig to approximately 2,000 psig to produce a second hydrotreated gasoil having lower concentrations of sulfur, nitrogen, and oxygen than the first hydrotreated gasoil;

adding the second hydrotreated gasoil to a third hydrotreating reactor operating at approximately 300° C. to approximately 330° C. and approximately 500 psig to approximately 2,000 psig to produce a third hydrotreated gasoil having lower concentrations of sulfur, nitrogen, and oxygen than the second hydrotreated gasoil;

adding the third hydrotreated gasoil to a gas/liquid separator to separate a refined gasoil from a gas phase; and adding the gas phase to a water scrubber to recover hydrogen from the liquid phase, wherein a portion of the recovered hydrogen is added to the first hydrotreating reactor, wherein the temperature of each consecutive hydrotreating reactor is increased relative to the prior hydrotreating reactor.

30. The process for refining used oil of claim 29, wherein the refined gasoil comprises less than approximately 0.05 wt. % nitrogen, less than approximately 0.1 wt. % oxygen, and less than approximately 100 ppmw sulfur.

31. The process for refining used oil of claim 29, wherein the refined gasoil comprises less than approximately 0.1 ppmw calcium, less than approximately 0.1 ppmw magnesium, less than approximately 0.2 ppmw sodium, less than approximately 0.5 ppmw silicon, less than approximately 0.1 ppmw zinc, less than approximately 1 ppmw phosphorus, and less than approximately 1 ppmw boron.

32. A process for refining used oil, the process comprising:

vacuum distilling a used oil to produce an unrefined gasoil having a concentration of metallic impurities and a concentration of heteroatom impurities;

flowing the unrefined gasoil and a total volume of hydrogen into a first hydrotreating reactor having a temperature ranging from approximately 245° C. to approximately 260° C. to produce a first hydrotreated gasoil having a lower concentration of metallic impurities than the unrefined gasoil;

flowing the first hydrotreated gasoil and an unreacted portion of the volume of hydrogen into one or more additional hydrotreating reactors to produce a refined gasoil having a lower concentration of heteroatom impurities than the first hydrotreated gasoil, wherein the temperature in the one or more additional hydrotreating reactor ranges from approximately 260° C. to approximately 330° C., recovering a gas comprising hydrogen from the one or more additional hydrotreating reactors, wherein a first portion of recovered gas is purged and second portion of the recovered gas is recycled back into the first hydrotreating reactor to comprise a portion of the total volume of hydrogen, wherein the total volume of hydrogen further comprises a volume of fresh hydrogen to replace (1) hydrogen consumed in the first hydrotreating reactor and the one or more additional hydrotreating reactors and (2) hydrogen lost in the purged first portion of the recovered gas, wherein the volume of fresh hydrogen is in excess of the stoichiometric amount necessary to remove the concentration of heteroatom impurities from the unrefined gasoil, wherein the temperature of each consecutive hydrotreating reactor is increased relative to the prior hydrotreating reactor.

33. The process for refining used oil of claim 32, wherein the volume of fresh hydrogen is greater than approximately 1.5 times the stoichiometric amount necessary to remove the concentration of heteroatom impurities from the unrefined gasoil.

34. The process for refining used oil of claim 32, wherein the volume of fresh hydrogen is greater than approximately 2.0 times the stoichiometric amount necessary to remove the concentration of heteroatom impurities from the unrefined gasoil.

35. The process for refining used oil of claim 32, wherein the volume of fresh hydrogen is greater than approximately 2.5 times the stoichiometric amount necessary to remove the concentration of heteroatom impurities from the unrefined gasoil.

36. The process for refining used oil of claim 32, wherein the hydrogen is present in the hydrotreating reactors from approximately 5,000 cubic meters to approximately 20,000 $m^3$ per 1 $m^3$ of the unrefined gasoil.

37. The process of claim 32, wherein the concentration of the metallic impurities of the unrefined gasoil is reduced by 40% or more by the first hydrotreating reactor.

38. The process of claim 32, wherein the concentration of the metallic impurities of the unrefined gasoil is reduced by 60% or more by the first hydrotreating reactor.

39. The process of claim 32, wherein the concentration of the metallic impurities of the unrefined gasoil is reduced by 70% or more by the first hydrotreating reactor.

* * * * *